US012715637B2

(12) United States Patent
Hu et al.

(10) Patent No.: US 12,715,637 B2
(45) Date of Patent: Aug. 25, 2026

(54) VACUUM SEALER

(71) Applicant: Ningbo Kedly Appliance Industry Co., Ltd., Ningbo (CN)

(72) Inventors: Zhihe Hu, Ningbo (CN); Wei Hu, Ningbo (CN)

(73) Assignee: Ningbo Kedly Appliance Industry Co., Ltd. (CN)

( * ) Notice: Subject to any disclaimer, the term of this patent is extended or adjusted under 35 U.S.C. 154(b) by 0 days.

(21) Appl. No.: 19/208,756

(22) Filed: May 15, 2025

(65) Prior Publication Data

US 2026/0054873 A1 Feb. 26, 2026

(30) Foreign Application Priority Data

Aug. 22, 2024 (CN) ..... 202411158692.2

(51) Int. Cl.
*B65B 31/04* (2006.01)
*B65B 51/14* (2006.01)

(52) U.S. Cl.
CPC ..... *B65B 31/048* (2013.01); *B65B 51/146* (2013.01)

(58) Field of Classification Search
None
See application file for complete search history.

(56) References Cited

U.S. PATENT DOCUMENTS

2015/0135641 A1* 5/2015 Hu ..... B65B 31/024 53/86
2020/0299013 A1* 9/2020 Ye ..... B29C 66/81821
2022/0227511 A1* 7/2022 Cho ..... B65B 51/146
2022/0250779 A1* 8/2022 Li ..... B65B 51/10

FOREIGN PATENT DOCUMENTS

CN 207550600 U 6/2018
CN 208882262 U 5/2019
CN 211055476 U * 7/2020

* cited by examiner

*Primary Examiner* — Tanzim Imam
(74) *Attorney, Agent, or Firm* — Emerson, Thomson & Bennett, LLC; Roger D. Emerson; Peter R. Detorre

(57) ABSTRACT

Provided is a vacuum sealer, comprising a base and a cover, the cover being movably hinged to a rear edge of the base, the base being configured with a vacuum pump, a control circuit board, and a power cord, wherein the vacuum pump is electrically connected to the control circuit board; an upper vacuum chamber and a lower vacuum chamber, wherein the upper vacuum chamber corresponds to the lower vacuum chamber to form a heat-seal area when the cover is closed against the base, wherein the upper and lower vacuum chambers are each configured with a sealing gasket at their peripheries, respectively; a heating sheet assembly electrically connected to the control circuit board being positioned on a front edge of the base opposite to the hinged rear edge; a heat-seal strip being positioned on a front edge of the cover opposite to the hinged rear edge.

8 Claims, 4 Drawing Sheets

VACUUM SEALER

CROSS-REFERENCE TO RELATED APPLICATIONS

This application claims priority to Chinese Application NO. 202411158692.2, having a filing date of Aug. 22, 2024, the entire contents of which are hereby incorporated by reference.

FIELD OF TECHNOLOGY

The following relates to the technical field of vacuum sealing products, in particular it relates to a vacuum sealer.

BACKGROUND

Currently, the vacuum sealers evacuate a vacuum packaging bag by using a vacuum pump, and then seal the bag opening through a thermal sealing process. By using the vacuum sealer to store food in vacuum-sealed packaging bag, the vacuum level can be sustained for extended periods, achieving food preservation.

In the prior art, the vacuum sealers commonly use the following types of heating devices:

1. The heating device is a flat-shape metal heating strip: Such strip has low electrical resistance and cannot be directly heated by electric heating. It requires a printed circuit board assembly (PCBA) to control and reduce the voltage, along with a high-voltage to low-voltage converter, which increases production costs. To consider cost balance, heating power is typically limited to about 120 watts. With such low power, the heating strip has the sealing width of only 2 to 3 mm, so that the heating power is low and the sealing width is narrow, thereby affecting the sealing performance of the vacuum sealer.

2. The heating device is a metal heating wire: Such wire is pre-spiraled around an insulating rod. However, it involves disadvantages, such as complex manufacturing, poor heat transfer, reduced contact area with the bag opening, narrow sealing width, poor heat sealing, and uneven heat distribution, significantly affecting the sealing performance.

Thus, there is an urgent need to develop a vacuum sealer that can be heated directly by mains electricity without additional voltage converters, achieving high heating power and a wider sealing area.

SUMMARY

To overcome the defects of the prior art, it is an objective of the present disclosure to provide a vacuum sealer that can be heated directly by mains electricity, thereby eliminating the need for voltage converters, with advantages such as high heating power, a wide sealing area, excellent sealing performance, stability, and low production costs.

To achieve this purpose, the present disclosure adopts the following technical solutions:

a vacuum sealer comprising a base and a cover, the cover being movably hinged to a rear edge of the base, the base being configured with a vacuum pump, a control circuit board, and a power cord, wherein the vacuum pump is electrically connected to the control circuit board; an upper vacuum chamber and a lower vacuum chamber, wherein the upper vacuum chamber corresponds to lower vacuum chamber to form a heat-seal area when the cover is closed against the base, wherein the upper and lower vacuum chambers are each configured with a sealing gasket at their peripheries, respectively; a heating sheet assembly electrically connected to the control circuit board being positioned on a front edge of the base opposite to the hinged rear edge; a heat-seal strip being positioned on a front edge of the cover opposite to the hinged rear edge to cooperate with the heating sheet assembly, wherein the heating sheet assembly comprises a metal heating sheet and a high-temperature-resistant insulating film coating the metal heating sheet, wherein the metal heating sheet is formed with a hollowed pattern, shaping the metal heating sheet into one or more continuous, densely arranged curved wires to significantly increase electricity resistance, wherein the metal heating sheet is laminated with the high-temperature-resistant resin and insulating film to maintain structural integrity, providing thermal insulation and electrical isolation.

In one embodiment, a connecting wire provided on both ends of the metal heating sheet is directly electrically connected to the mains voltage terminal on the control circuit board.

In another embodiment, the heating sheet assembly is formed by generating the hollowed pattern of the metal heating sheet via a chemical etching process, and then bonding with high-temperature-resistant resin and insulating film onto the metal heating sheet.

In another embodiment, the metal heating sheet comprises a single metal wire uniformly bent into a densely arranged curved wire.

In another embodiment, the metal heating sheet comprises at least two metal wires uniformly bent into a densely arranged curved wires.

In another embodiment, the heating sheet assembly further comprises a high-temperature-resistant transparent adhesive tape, a mounting bracket, and a thermal conductive sheet. The thermal conductive sheet, the metal heating sheet coated by the high-temperature-resistant insulating film and the adhesive tape are mounted on the mounting bracket. A temperature control switch and a switch fixed mount, a thermosensitive resistor and a resistor fixed mount are installed on left and right sides of the mounting bracket, respectively.

In another embodiment, both the temperature control switch and the thermosensitive resistor are electrically connected to the metal heating sheet assembly. The temperature control switch automatically controls a working time or a heating power of the temperature control switch based on a temperature data detected by the thermosensitive resistor, thereby controlling the working temperature of the metal heating sheet.

In another embodiment, both ends of the high-temperature-resistant insulating film are inwardly bent toward its bottom and extend to form a connection tab with mounting holes. Both ends of the high-temperature-resistant transparent adhesive tape are each provided with an inward-folded edge. The high-temperature-resistant transparent adhesive tape, metal heating sheet, high-temperature-resistant insulating film, and thermal conductive sheet are sequentially laminated on an upper surface of the mounting bracket. The high-temperature-resistant transparent adhesive tape, metal heating sheet, and high-temperature-resistant insulating film wrap around both sides of the mounting bracket. The connection tabs at both ends of the high-temperature-resistant insulating film are secured to the bottom of the mounting bracket.

In another embodiment, the sealing width ranges from 5 to 12 mm, and the sealer reaches a heating power above 150 W, with a temperature ranging from 150 to 200° C.

Compared to the prior art, the present disclosure has the advantages as follows:

(1) In the present disclosure, the heating sheet assembly comprises a metal heating sheet and a high-temperature-resistant insulating film coating the metal heating sheet. The metal heating sheet is formed with a hollowed pattern, shaping the metal heating plate into one or more continuous, densely arranged curved wires to significantly increase electricity resistance. The metal heating sheet is laminated with the high-temperature-resistant insulating film to maintain structural integrity, providing thermal insulation and electrical isolation.

(2) In the present disclosure, a connecting wire provided on both ends of the metal heating sheet is directly electrically connected to the mains voltage terminal of the control circuit board. This configuration allows direct heating via mains electricity without requiring additional voltage reduction, resulting in reduced production costs, simplified circuit design, and conserved energy and reduced consumption.

(3) The vacuum sealer of the present disclosure achieves a heating seal width of 5 to 12 mm. This wider sealing width provides superior sealing performance with enhanced airtightness, effectively minimizing defect rates associated with narrow sealing width and substantially improving the reliability and stability of vacuum sealing.

(4) The vacuum sealer of the present disclosure maintains high heating power (exceeding 150 W) and high sealing temperatures (150 to 200° C.) without additional cost requirements. This technical solution effectively reduces heat-sealing time while improving working power.

BRIEF DESCRIPTION

The present disclosure is described in detail below with reference to the accompanying drawings and specific embodiments:

DETAILED DESCRIPTION

Embodiment

Figure 1:
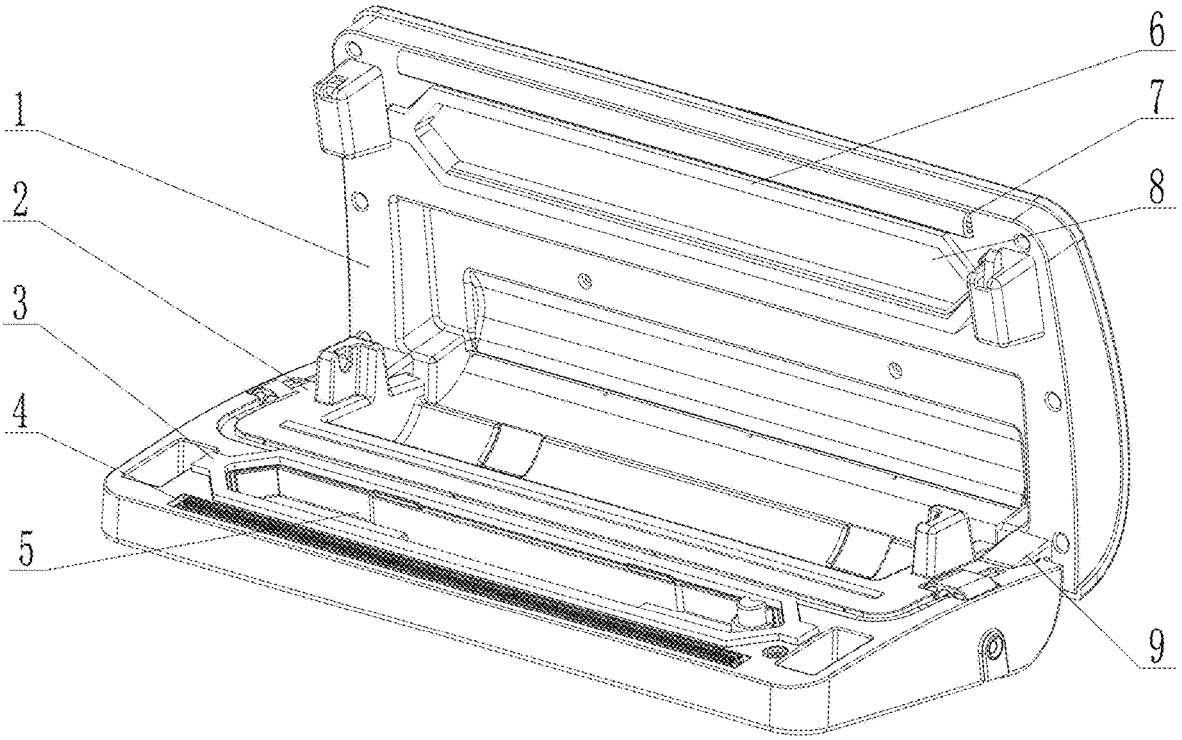
FIG. 1 is a first schematic structural diagram of the vacuum sealer according to the present disclosure.
Figure 2:
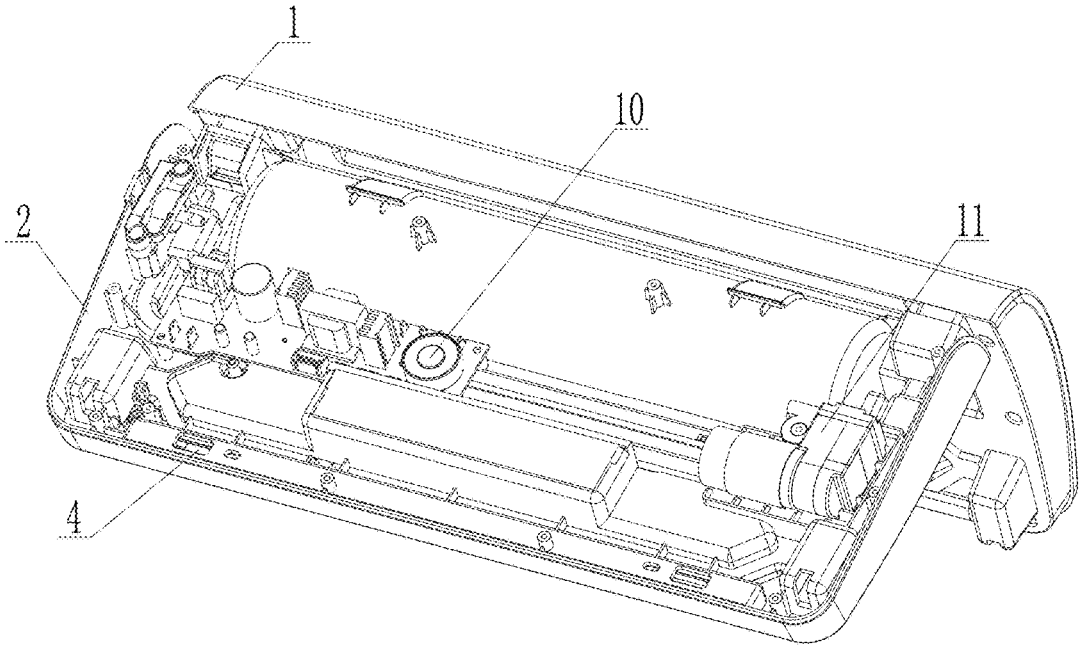
FIG. 2 is a second schematic structural diagram of the vacuum sealer according to the present disclosure.
Figure 3:
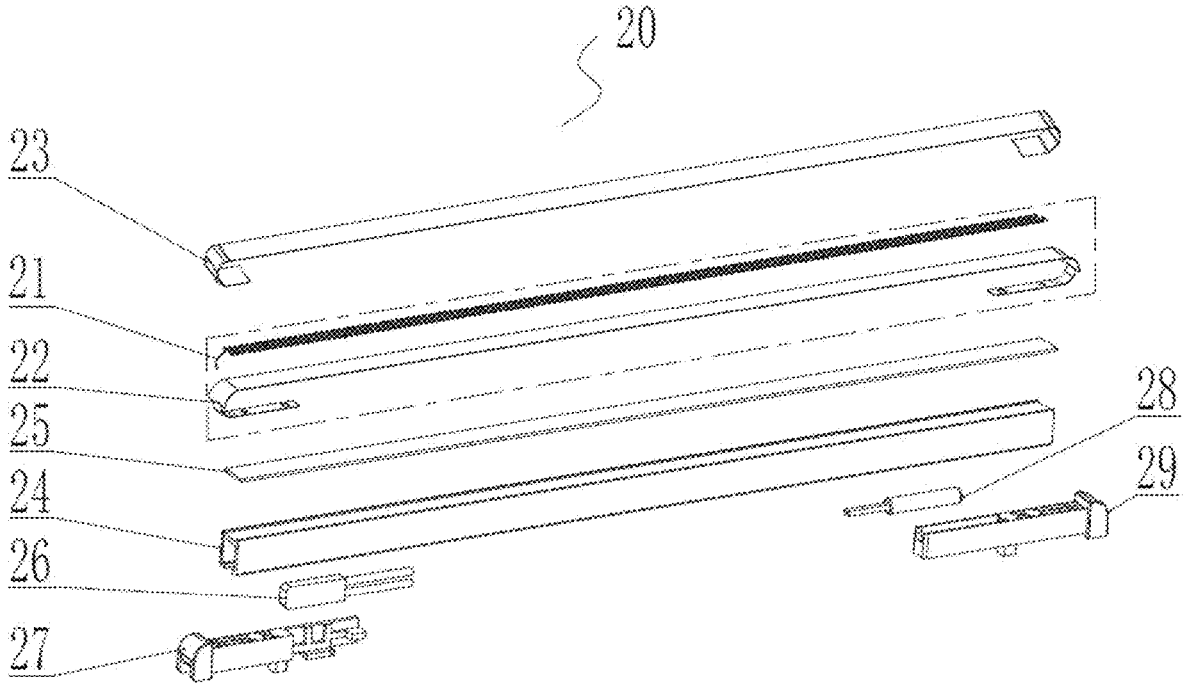
FIG. 3 is an exploded perspective view of the heating sheet assembly of the present disclosure.
Figure 4:
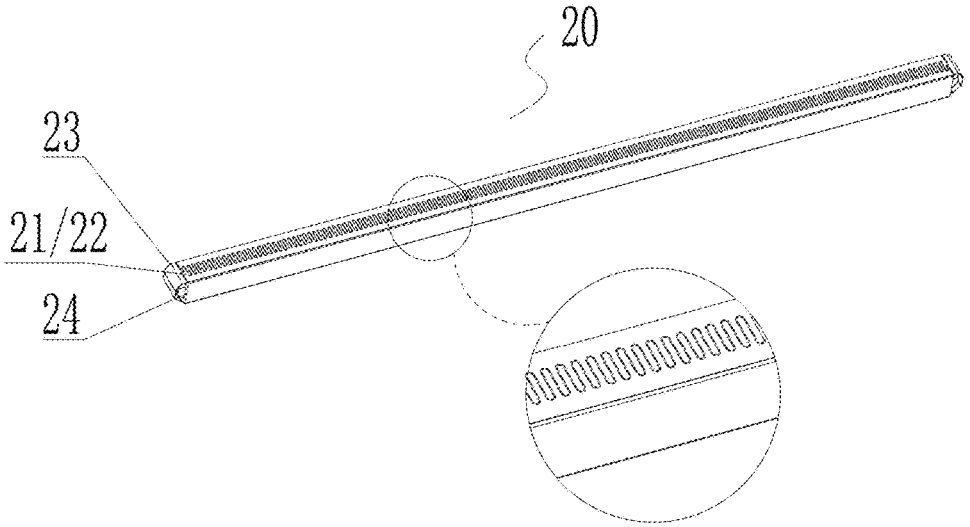
FIG. 4 is a perspective structural diagram of the heating sheet assembly of the present disclosure.
Figure 5:
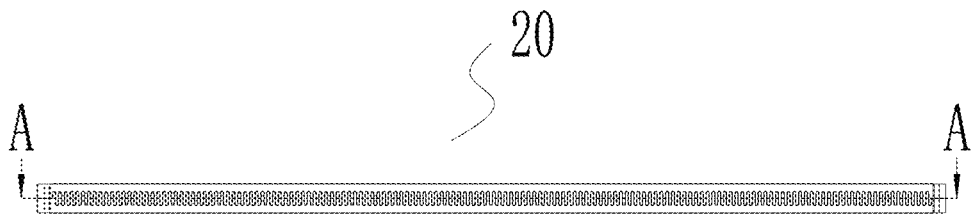
FIG. 5 is a top view of the structure shown in FIG. 4.
Figure 6:
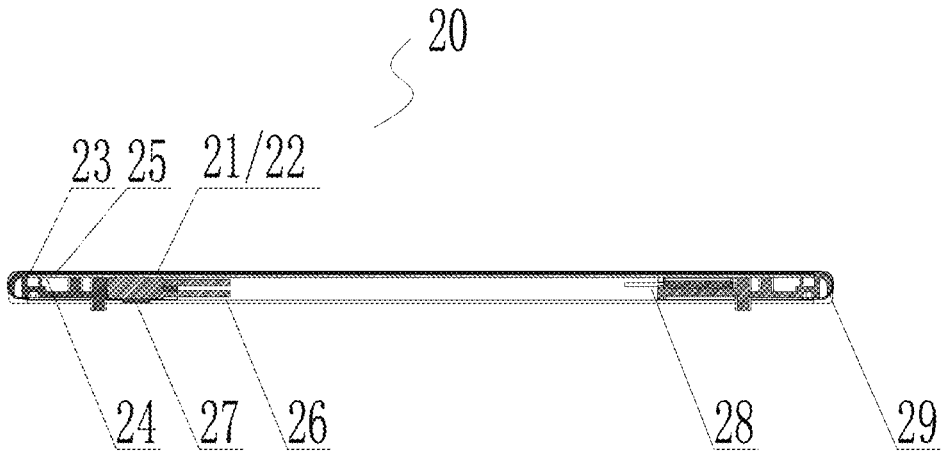
FIG. 6 is an internal lateral cross-sectional view of the structure shown in FIG. 4.
Figure 7:
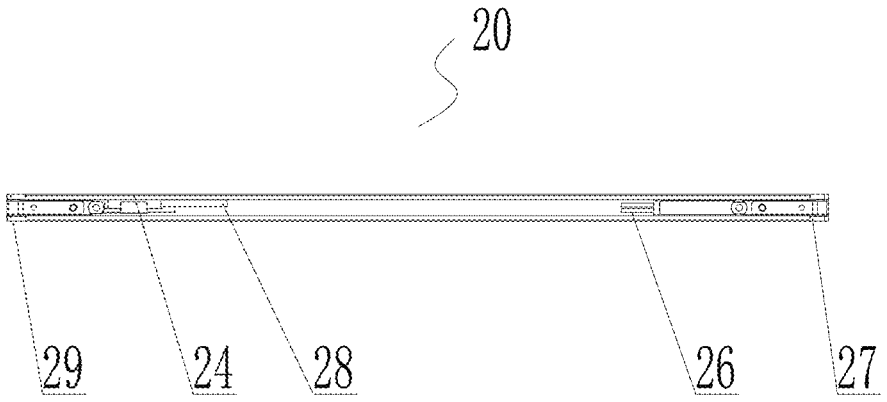
FIG. 7 is a side view of the structure shown in FIG. 4 viewed from the back.
Figure 8:
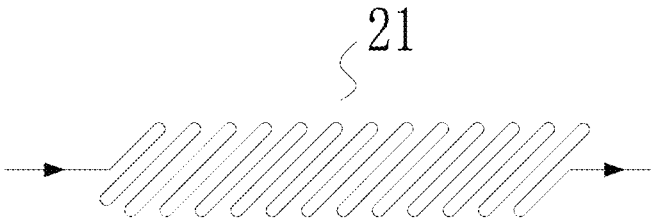
FIGS. 8 to 12 are schematic diagrams of five different structural patterns of the metal heating sheet.
Figure 9:
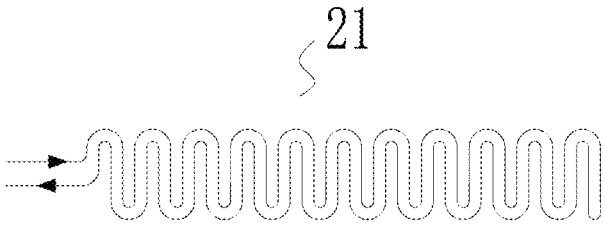
Figure 10:
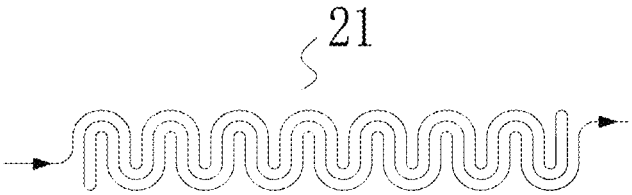
Figure 11:
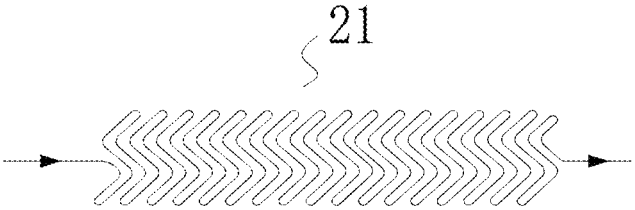
Figure 12:
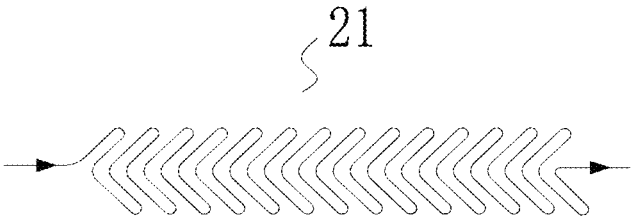

As shown in FIGS. 1 and 2, the vacuum sealer described in the present disclosure comprises a cover 1 and a base 2. The cover 1 is movably hinged to a rear edge of and the base 2 via a hinge 9. The base 2 is configured with a vacuum pump 11, a control circuit board 10, and a power cord, wherein the vacuum pump 11 is electrically connected to the control circuit board 10. An upper vacuum chamber 8 and a lower vacuum chamber 5 are provided in the cover 1 and base 2, and the upper vacuum chamber 8 corresponds to the lower vacuum chamber 5 to form a heat-seal area when cover 1 is closed against the base 2. An upper sealing gasket 6 and a lower sealing gasket 3 are peripherally provided around the upper vacuum chamber 8 and lower vacuum chamber 5 respectively. A heating sheet assembly 20 electrically connected to the control circuit board 10 is positioned on a front edge of the base 2 opposite to the hinge 9. A heat-seal strip 7 is positioned on a front edge of the cover 1 opposite to the hinge 9, being configured to cooperate with the heating sheet assembly 20. The heating sheet assembly 20 comprises a metal heating sheet 21 and a high-temperature-resistant insulating film 22 coating the metal heating sheet 21. The metal heating sheet 21 is formed with a hollowed pattern, shaping the metal heating sheet 21 into one or more continuous, densely arranged curved wires to significantly increase its electricity resistance. The metal heating sheet 21 is laminated with the high-temperature-resistant resin and insulating film 22 to maintain its structural integrity, providing thermal insulation and electrical isolation.

As shown in FIGS. 3 to 12, a connecting wire provided on both ends of the metal heating sheet 21, is directly electrically connected to the mains voltage terminal of the control circuit board 10.

In the present disclosure, as shown in FIGS. 5, 8 to 12, the heating sheet assembly 20 is formed by generating the hollowed pattern on the metal heating plate 21 via a chemical etching process, and then bonding with a high-temperature-resistant resin and insulating film 22 onto the metal heating sheet 21, wherein the metal heating sheet 21 is formed with a hollowed pattern, shaping the metal heating sheet into one or more continuous, densely arranged curved metal wires. Further, the curved and densely arranged metal wire on the described metal heating sheet 21 can be in various other forms and is not limited to the shapes described in the present disclosure. The drawings only show several examples and are not exhaustive.

As shown in FIGS. 3 to 7, the heating sheet assembly 20 further comprises a high-temperature-resistant transparent adhesive tape 23, a mounting bracket 24, and a thermal conductive sheet 25. The thermal conductive sheet 25, the metal heating sheet 21 coated with a high-temperature-resistant insulating film 22, and the high-temperature-resistant transparent adhesive tape 23 are mounted on the mounting bracket 24. A temperature control switch 27, a switch fixed mount 27, a thermosensitive resistor 28, and a resistor fixed mount 29 are installed on left and right sides of the mounting bracket 24, respectively.

Both the temperature control switch 26 and the thermosensitive resistor 28 are electrically connected to the metal heating sheet assembly 20. The temperature control switch 26 automatically controls a working time or a heating power of the temperature control switch 26 based on a temperature data detected by the thermosensitive resistor 28, thereby regulating the working temperature of the metal heating sheet 21.

Both ends of the high-temperature-resistant insulating film 22 are inwardly bent toward its bottom and extend to form a connection tab with mounting holes. Both ends of the high-temperature-resistant transparent adhesive tape 23 are each provided with an inward-folded edge. The high-temperature-resistant transparent adhesive tape 23, the metal heating sheet 21, the high-temperature-resistant insulating film 22, and the thermal conductive sheet 25 are sequentially laminated on an upper surface of the mounting bracket 24. The high-temperature-resistant transparent adhesive tape 23, the metal heating sheet 21, and the high-temperature-resistant insulating film 22 wrap around both sides of the mounting bracket 24. The connection tab at both ends of the high-temperature-resistant insulating film 22 are secured to the bottom of the mounting bracket 24.

In the present disclosure, the heat-sealing width of the vacuum sealer ranges from 5 to 12 mm, with a heating power of above 150 W. The wider heat-sealing width and high heating power (over 150 W) allow for a working temperature of 150 to 200° C. during sealing, enabling fast and efficient sealing.

In the present disclosure, the "front edge" refers to the side of the cover or base opposite to the hinged position, while the "rear edge" refers to the side where the cover is hinged to the base.

The present disclosure is not limited to the above-described embodiments. Any modifications or variations that do not depart from the spirit and scope of the present disclosure and fall within the claims and equivalent technical scope of the disclosure shall also be encompassed by the present disclosure.

The invention claimed is:

1. A vacuum sealer, comprising: a base and a cover, the cover being movably hinged to a rear edge of the base, the base being configured with a vacuum pump, a control circuit board, and a power cord, wherein the vacuum pump is electrically connected to the control circuit board; an upper vacuum chamber and a lower vacuum chamber, wherein the upper vacuum chamber corresponds to the lower vacuum chamber to form a heat-seal area when the cover is closed against the base, and wherein the upper and lower vacuum chambers are each configured with a sealing gasket at their peripheries; a heating sheet assembly electrically connected to the control circuit board and positioned on a front edge of the base opposite to the rear edge of the base; and a heat-seal strip positioned on a front edge of the cover opposite to the rear edge of the base;

wherein the heating sheet assembly comprises a metal heating sheet and a high-temperature-resistant insulating film coating the metal heating sheet; wherein the metal heating sheet is formed with a hollowed pattern; shaping the metal heating sheet into one or more continuous, densely arranged curved wires;

wherein the heating sheet assembly further comprises a high-temperature-resistant transparent adhesive tape, a mounting bracket, and a thermal conductive sheet;

wherein the thermal conductive sheet and the metal heating sheet coated by the high-temperature-resistant insulating film are mounted on the mounting bracket; and wherein a temperature control switch and a switch fixed mount, and a thermosensitive resistor and a resistor fixed mount are installed on left and right sides of the mounting bracket, respectively.

2. The vacuum sealer of claim 1, wherein a connecting wire provided on both ends of the metal heating sheet is directly electrically connected to a mains voltage terminal on the control circuit board.

3. The vacuum sealer of claim 1, wherein the heating sheet assembly is formed by generating the hollowed pattern of the metal heating sheet via a chemical etching process, and then bonding a high-temperature-resistant resin and the insulating film onto the metal heating sheet.

4. The vacuum sealer of claim 3, wherein the metal heating sheet comprises a single metal wire uniformly bent into a densely arranged curved wire.

5. The vacuum sealer of claim 3, wherein the metal heating sheet comprises at least two metal wires uniformly bent into densely arranged curved wires.

6. The vacuum sealer of claim 1, wherein both the temperature control switch and the thermosensitive resistor are electrically connected to the heating sheet assembly, wherein the temperature control switch automatically controls a working time or a heating power of the temperature control switch based on a temperature data detected by the thermosensitive resistor, thereby controlling a temperature of the metal heating sheet.

7. The vacuum sealer of claim 1, wherein: opposite ends of the high-temperature-resistant insulating film are inwardly bent toward its bottom and extend to form a connection tab with mounting holes; opposite ends of the high-temperature-resistant transparent adhesive tape are each provided with an inward-folded edge; the high-temperature-resistant transparent adhesive tape, the metal heating sheet, the high-temperature-resistant insulating film, and the thermal conductive sheet are sequentially laminated on an upper surface of the mounting bracket, while the high-temperature-resistant transparent adhesive tape, the metal heating sheet, and the high-temperature-resistant insulating film wrap around the left and right sides of the mounting bracket with the connection tabs at the opposite ends of the high-temperature-resistant insulating film secured to a bottom of the mounting bracket.

8. The vacuum sealer of claim 1, wherein the vacuum sealer has a sealing width ranging from 5 to 12 mm, has a heating power of above 150 W, and achieves a sealing temperature between 150 and 200° C. during a heating process.

* * * * *